US007277064B2

(12) United States Patent
Hogsett

(10) Patent No.: US 7,277,064 B2
(45) Date of Patent: Oct. 2, 2007

(54) SATELLITE DISH FACADE WITH MAGNET

(76) Inventor: Samuel W. Hogsett, P.O. Box 97, 1463 Cty Rd. 9, Crown City, OH (US) 45623

( * ) Notice: Subject to any disclaimer, the term of this patent is extended or adjusted under 35 U.S.C. 154(b) by 65 days.

(21) Appl. No.: 11/238,330

(22) Filed: Sep. 29, 2005

(65) Prior Publication Data

US 2007/0069972 A1 Mar. 29, 2007

(51) Int. Cl.
*H01Q 1/42* (2006.01)

(52) U.S. Cl. ..... 343/872; 343/912

(58) Field of Classification Search ..... 343/872, 343/912; 359/853

See application file for complete search history.

(56) References Cited

U.S. PATENT DOCUMENTS

| | | | | |
|---|---|---|---|---|
| 4,804,972 | A | 2/1989 | Schudel | |
| D304,454 | S | 11/1989 | Serres | |
| 5,283,592 | A | 2/1994 | Bogorad et al. | |
| 5,451,972 | A | 9/1995 | Franklin | |
| 5,528,253 | A | 6/1996 | Franklin | |
| 5,617,107 | A * | 4/1997 | Fleming | 343/704 |
| 5,729,241 | A | 3/1998 | Ergen et al. | |
| 5,815,125 | A | 9/1998 | Kelly et al. | |
| 5,940,047 | A | 8/1999 | Pfnister | |
| 6,191,753 | B1 | 2/2001 | Ellis et al. | |
| 6,406,155 | B1 * | 6/2002 | Yeomans | 359/853 |
| 6,714,167 | B1 | 3/2004 | Gusick, Jr. | |

FOREIGN PATENT DOCUMENTS

GB 2246242 A * 1/1992

* cited by examiner

*Primary Examiner*—Hoang V. Nguyen
(74) *Attorney, Agent, or Firm*—Waters Law Group, PLLC; Robert R. Waters; Olen L. York, III

(57) ABSTRACT

A facade or cover for a satellite dish has a magnet or magnetic base by which the facade is removably attachable to the parabolic structure of the satellite dish. The magnet or magnetic base is magnetically attracted to the metal composition of the parabolic structure of the satellite dish. The facade may have indicia. The facade may comprise a body having a magnetic base and a face coupled to the base. The body is oriented so that the magnetic base is oriented to the rear of the body, and the face is oriented to the front of the body, so that when the body is placed onto the surface of the parabolic structure P the face is visible to onward observers and the magnetic base is adjacent to and coupled with the surface of the parabolic structure.

20 Claims, 8 Drawing Sheets

SATELLITE DISH FACADE WITH MAGNET

RELATED U.S. APPLICATION DATA

Not applicable.

FIELD OF THE INVENTION

This invention relates generally to a satellite dish facade. Specifically, this invention relates to a satellite dish facade having a magnet or magnetic element that affixes the facade to the parabolic structure of the satellite dish without the need for drawstrings or other mechanical means of attachment.

BACKGROUND OF THE INVENTION

The emergence of the parabolic satellite receiving antenna, generally referred to as a satellite dish, as a replacement for wireline or cable transmission for public and private television network broadcasts has encouraged the development of niche industries for protecting the satellite dish and for providing a more pleasing aesthetic appearance around a house. Such covers are generally constructed from rigid or flexible plastic material to protect the satellite dish from environmental elements, thereby extending the useful life of the satellite dish and preserving the appearance of the satellite dish. The covers are generally of the type that merely slip over and around the satellite dish, with the cover then secured by a rope, cord or drawstring. In many cases, the cover also extends over the receiver horn (arm) support structure, which may interfere with the transmission of satellite signals between the parabolic structure and the receiver horn (arm).

There have been many attempts to invent and improve upon the existing art so as to provide a superior satellite dish cover. For example, U.S. Pat. Nos. 5,451,972 and 5,528,253, each issued to Sharon Franklin, respectively disclose a satellite antenna dish cover. In the '972 patent, the cover is described as having a sheet of non-transparent flexible material having a circular outline with folded portions for enclosing a drawcord, cord tightening device and means for rotating and restraining the cord tightening device (spool). In the '253 patent, the cover is described as having three sections of stretchable synthetic fabric forming a conically shaped cover with means for fastening the edges of the cover to the satellite dish. Although each device performs its intended function, these covers suffer from several drawbacks. The covers require a significant amount of fabric to cover the face of the satellite dish and to provide excess material at the rear of the dish for securing the cover thereto. Furthermore, embodiments employing a drawstring or cord require additional fabric for forming the enclosure for the drawcord. In addition, these covers require additional components or elements, such as sewing of the seams for forming the enclosure and the drawcord element, among other items. Finally, the excess fabric material is susceptible to excessive movement (flapping) in high wind, and the wind may be able to physically displace the cover from the dish. The cover may also undesirably collect snow, ice, rain water, leaves or other similar environmental items.

Other covers fabricated from flexible materials include U.S. Pat. No. 6,714,167, issued to Raymond Gusick, U.S. Pat. No. 5,940,047, issued to David Pfnister, and U.S. Pat. No. 5,729,241, issued to Charles Ergen. Each of these patents disclose a cover formed of a flexible fabric, including vinyl or other durable materials. The Gusick and Pfnister patents disclose the use of a drawstring or hook and loop material for firmly securing the cover to the dish. Conversely, the Ergen patent discloses the use of lips for clipping portions of the device together. However, and similarly to the Franklin patents, these inventions suffer from many of the same drawbacks described above. Particularly with Gusick and Pfnister, the inventions require the user to bind the cover to the dish in a very tight fitting manner, thereby increasing the time necessary to install the cover onto a satellite dish.

Several patents are directed toward covers having a more rigid structure, generally constructed from either hardened plastic or metal. Specifically, U.S. Pat. No. 6,191,753, issued to Mark Ellis and Jeff Geer, describes a rigid cover having two cover members attached along a seam. However, the Ellis-Geer device appears to be bulky and appears to require much physical effort to install and remove from the satellite dish. Thus, the Ellis-Geer cover seems more complicated and requires several hands for installation and removal. Another rigid structure, constructed from metal, is disclosed in U.S. Pat. No. 5,815,125, issued to David Kelly and Michael Ryan. This patent discloses panels of metal attached to one another via a cinching mechanism. Like the Ellis-Geer device, the Kelly-Ryan device appears complex and difficult to install and remove. Furthermore, the use of metal increases the manufacturing time and costs, thus placing the device beyond the typical price point for consumers looking to improve the aesthetics of their house while also protecting the satellite dish.

A number of satellite dish covers are available via the Internet, generally copying the various aspects of the patents disclosed above, including fabric covers with drawstrings or cords, and including indicia on the viewable surface of the cover. As such, there is nothing known in the art that overcomes the deficiencies of the inventions described above, while providing an affordable and simple-to-install device for protecting a satellite dish and providing an aesthetically pleasing appearance to a house with a satellite dish. In particular, there is nothing in the art to suggest the present invention of providing a satellite dish facade having a magnet for securing the facade directly to the parabolic surface of the satellite dish, with the facade having a variety of geometries, colors and/or indicia for indicating any number of themes. As such, there is a need for such a device that has until now gone unfulfilled.

SUMMARY OF THE INVENTION

In one aspect of the present invention, a facade for a satellite dish having a magnet or magnetic base by which the facade is removably attachable to the parabolic structure of the satellite dish is disclosed. The magnet or magnetic base is magnetically attracted to the metal composition of the parabolic structure of the satellite dish. The magnet or magnetic base does not interfere with the transmission of signals by the satellite dish. The facade may have indicia, which may reflect any number and variety of themes personally pleasing to the user.

In another aspect of the present invention, the facade has a body comprising a magnetic base and a face coupled to the base. The body is oriented so that the magnetic base is oriented to the rear of the body, and the face is oriented to the front of the body, so that when the body is placed onto the surface of the parabolic structure P the face is visible to onward observers and the magnetic base is adjacent to and coupled with the surface of the parabolic structure. The face may have indicia, as well.

In another embodiment, a facade system for a satellite dish has a body comprising a magnetic base and a plurality of faces removably attachable to the base, wherein each one of the faces has a different indicia. The plurality of faces are removably attachable via attachment means from the magnetic base so as to provide a cover system having interchangeable faces to reflect the themes desired by the user.

In each of the embodiments described above, the face may be removably attachable to and from the magnetic base. This may be accomplished in several ways via attachment means. In one embodiment, the face is removably attachable to and from the base via attachment means such as a magnet, in which magnet is attracted to the magnet of the base. The magnet is positioned on the rear portion of the face. The magnet is magnetically attracted to the magnet or magnetic base of body, thereby coupling the face to the base. In another embodiment, the face is removably attachable to and from the base via attachment means such as hook and loop material. Either the hook or the loop material is attached to the magnet or magnetic base on an exterior surface, and the corresponding and complementary hook or loop material is attached to the rear portion of the face. In yet another embodiment, the face is removably attachable to and from the base via attachment means such as a snap button, the snap button comprising a button and a corresponding post. Either the button or the post is attached to the magnet or magnetic base on an exterior surface, and the corresponding and complementary button or post is attached to the rear portion of the face.

The face or faces may comprise a variety of substances, including a variety of plastic or polymeric material. In one embodiment, the face(s) comprises a hardened plastic, similar to that of children's toys, thereby providing a durable and protective material that is easily washable. In another embodiment, the face(s) comprises a vinyl exterior. The vinyl exterior may enclose or envelope a foam insert or material that creates a cushioned protective facade for the satellite dish. The vinyl exterior may also form an inflatable internal volume that may be inflated by air, fluid or solid material, such as sand or polystyrene.

The facade may have a variety of geometries/shapes, colors, indicia, or a combination thereof, to accommodate the variously sized satellite dishes available, and to customize the aesthetic of the facade to the personal tastes or themes desired by the user.

A method of advertising utilizing a satellite dish and a magnetic satellite dish facade or cover is envisioned, with the method comprising the steps of selecting indicia for placement on the facade, and placing the cover on the satellite dish. The method of advertising may also comprise the additional steps of removing the facade, and replacing the facade with another facade having different indicia. As described above in its various embodiments, the facade may comprise a magnetic base coupled with a face having indicia, including all the variations described previously incorporated by reference herein as if fully rewritten. Also as described above, the facade may comprise a magnetic base coupled with a face having indicia, wherein the face is removable to and from the base via attachment means, including all the variations described previously incorporated by reference herein as if fully rewritten.

As discussed above, the method and device of the present invention overcomes the disadvantages inherent in prior art methods and devices. In that respect, before explaining at least one embodiment of the invention in detail, it is to be understood that the invention is not limited in its application to the details of construction and to the arrangement of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Accordingly, those skilled in the art will appreciate that the conception upon which this invention is based may readily be utilized as a basis for the design of other structures, methods, and systems for carrying out the several purposes of the present invention. It is important, therefore, that the claims be regarded as including such equivalent constructions insofar as they do not depart from the spirit of the present invention.

Furthermore, the purpose of the foregoing Abstract is to enable the U.S. Patent and Trademark Office and the public generally, and especially including the practitioners in the art who are not familiar with patent or legal terms or phraseology, to determine quickly from a cursory inspection, the nature and essence of the technical disclosure of the application. The Abstract is neither intended to define the invention of the application, nor is it intended to be limiting to the scope of the invention in any way.

BRIEF DESCRIPTION OF THE DRAWINGS

Additional utility and features of the invention will become more fully apparent to those skilled in the art by reference to the following drawings, which illustrate the primary features of the preferred embodiment and numerous alternative embodiments.

DETAILED DESCRIPTION OF THE PREFERRED EMBODIMENT

The detailed description below is for preferred embodiments and is intended to explain the current invention. It is to be understood that a variety of other arrangements are also possible without departing from the spirit and scope of the invention.

Figure 1:
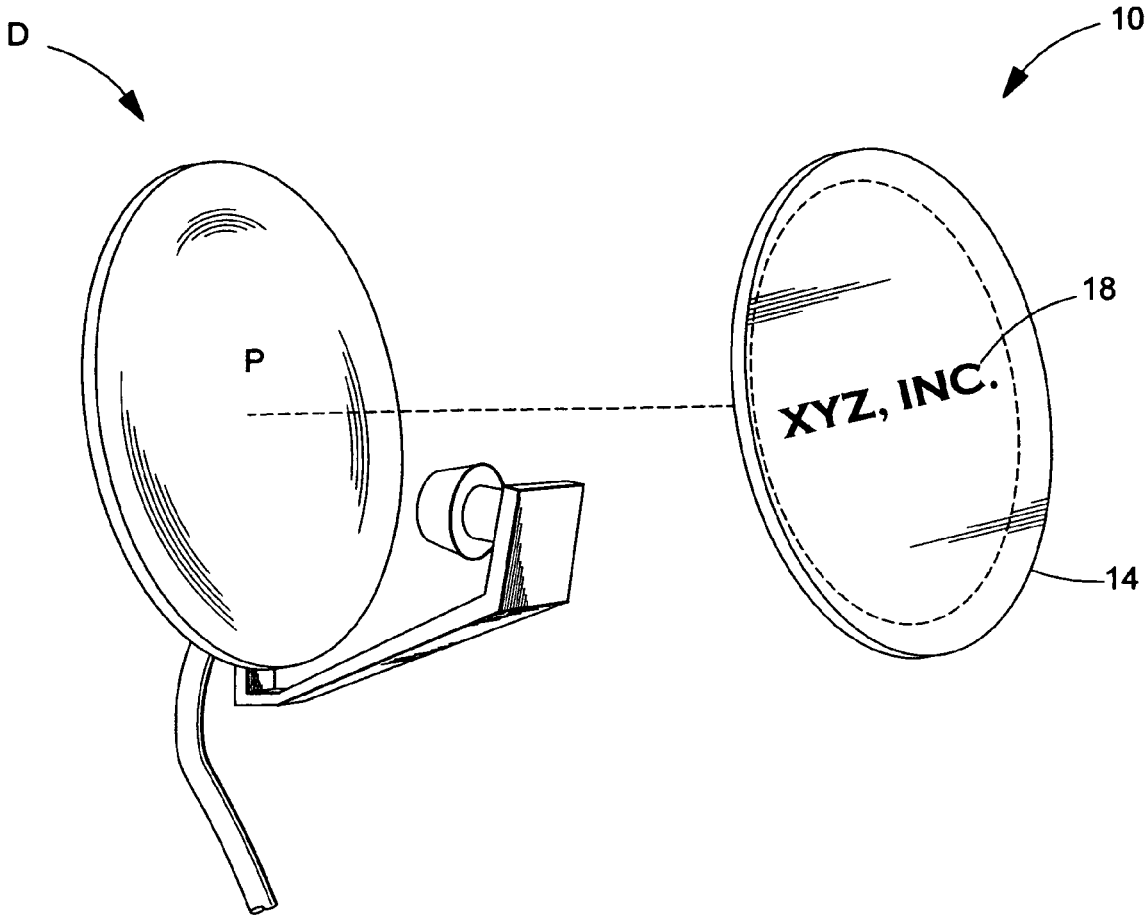
FIG. 1 is an exploded perspective view of a parabolic satellite dish D (and parabolic structure P) and a satellite dish facade as disclosed by the present application.
Figure 2:
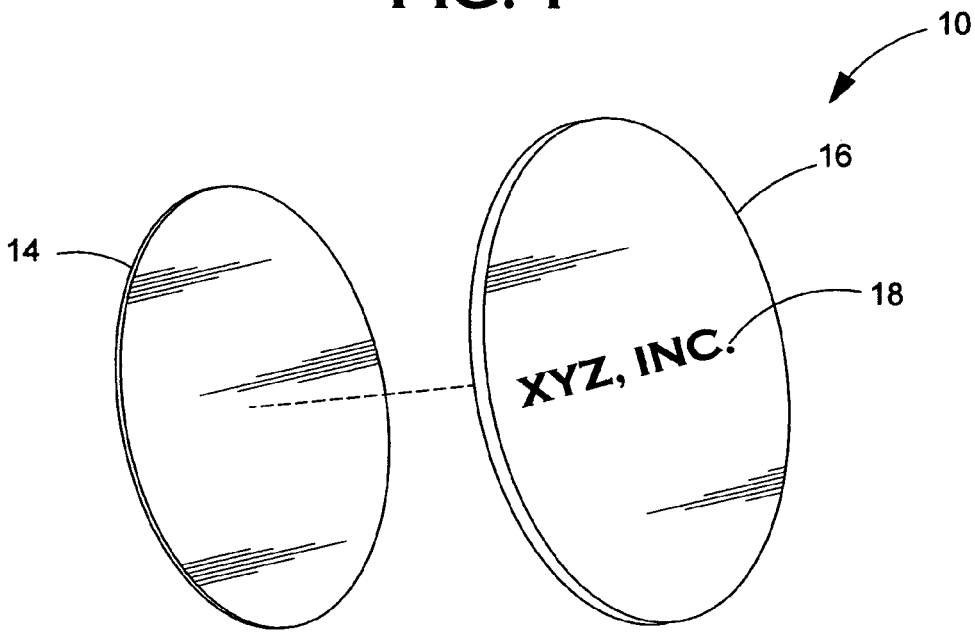
FIG. 2 is an exploded perspective view of the cover illustrating the magnet and the face comprising the body of the facade.
Figure 3:
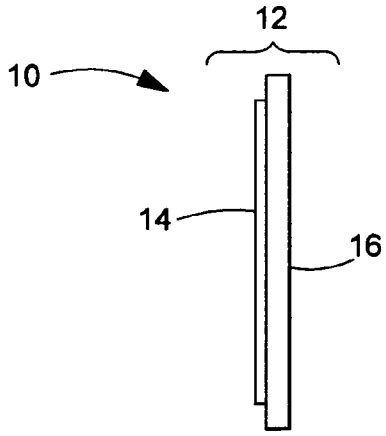
FIG. 3 is a side view of the body and the corresponding magnet and face comprising the body.
Figure 4A:
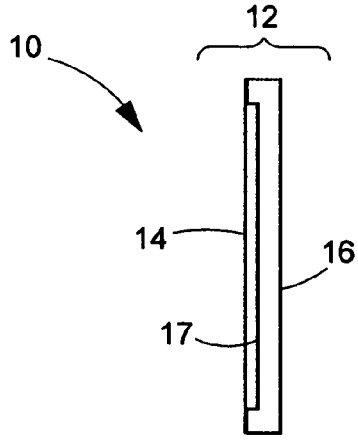
FIG. 4*a* is a side view of one aspect of the body comprising the magnet coupled to the face.
Figure 4E:
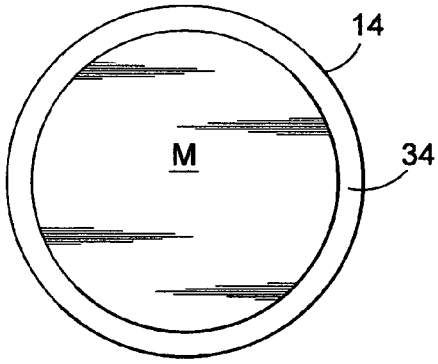
FIG. 4*e* is a front view of the magnetic base having a magnet and a perimeter circumscribing the magnet to accommodate a complementary perimeter formed on the face.
Figure 4B:
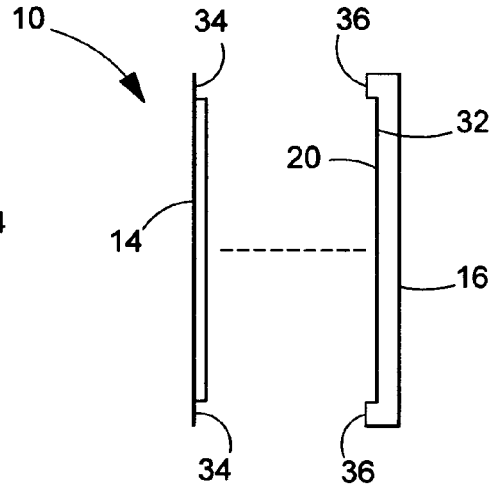
FIG. 4*b* is an exploded side view of one aspect of the body comprising the magnetic base and the face, the magnet and face coupled via an additional magnet attached to the rear portion of the face which is magnetically attracted to the magnetic base.
Figure 4D:
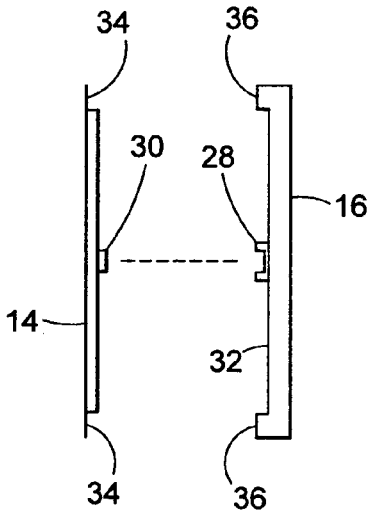
FIG. 4*d* is an exploded side view of another aspect of the body comprising the magnetic base and the face, the magnetic base and face coupled via a snap button.
Figure 4C:
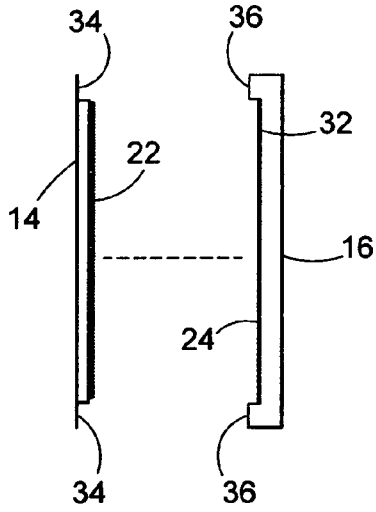
FIG. 4*c* is an exploded side view of another aspect of the body comprising the magnetic base and the face, the magnetic base and face coupled via hook and loop material.
Figure 5A:
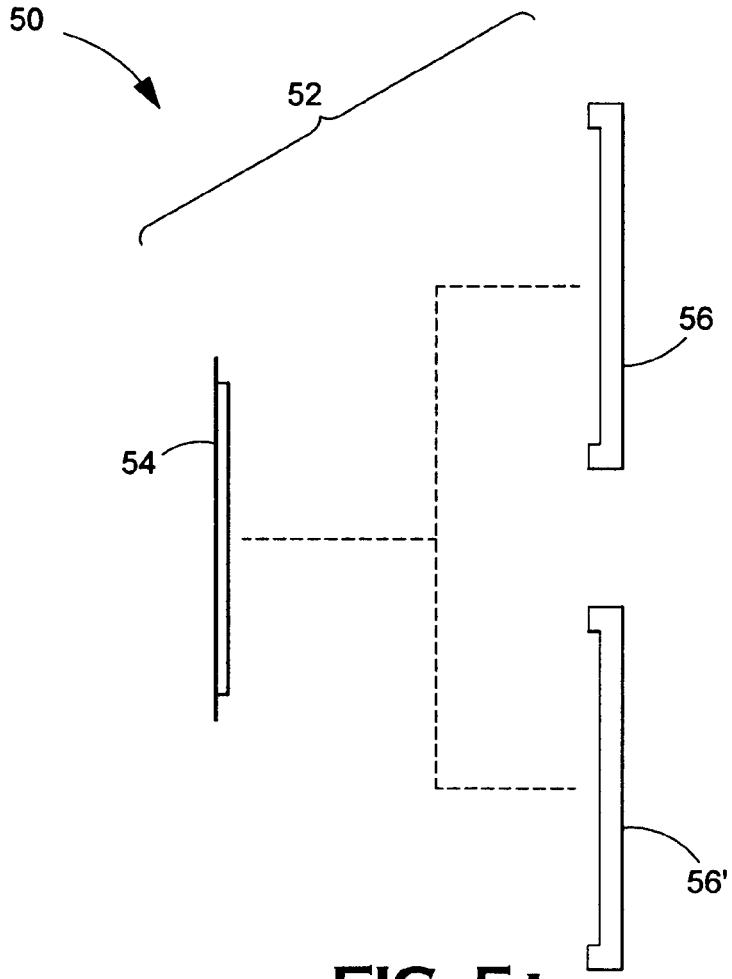
FIG. 5*a* is an exploded side view of a facade system having a magnetic base and a plurality of interchangeable faces having different indicia.
Figure 5B:
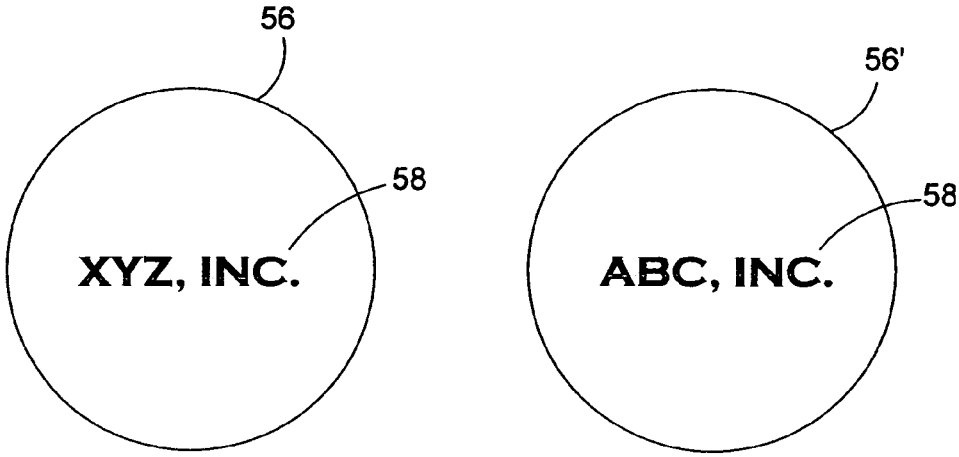
FIG. 5*b* is a front view of the plurality of interchangeable faces having different indicia.
Figure 6A:
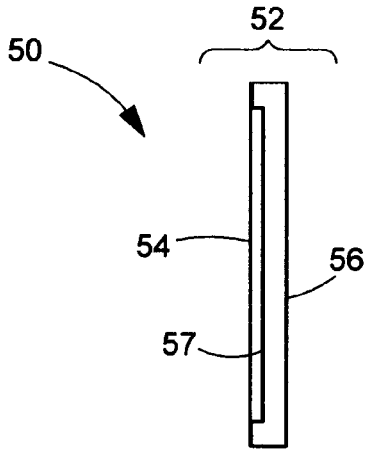
FIG. 6*a* is a side view of one aspect of the body comprising the magnet coupled to the face.
Figure 6B:
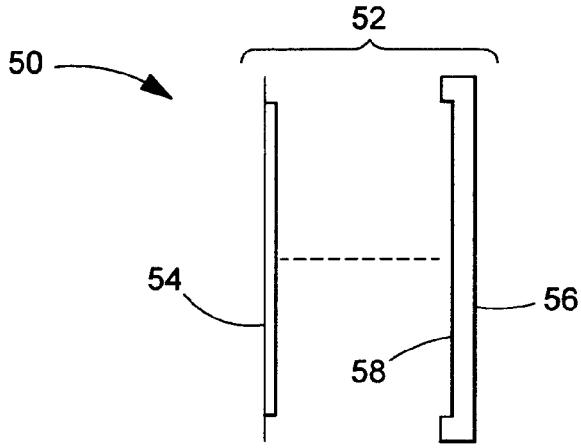
FIG. 6*b* is an exploded side view of the body similar to that depicted in FIG. 4*b* as applicable to the cover system depicted in FIG. 5*a* and FIG. 5*b;*
Figure 6C:
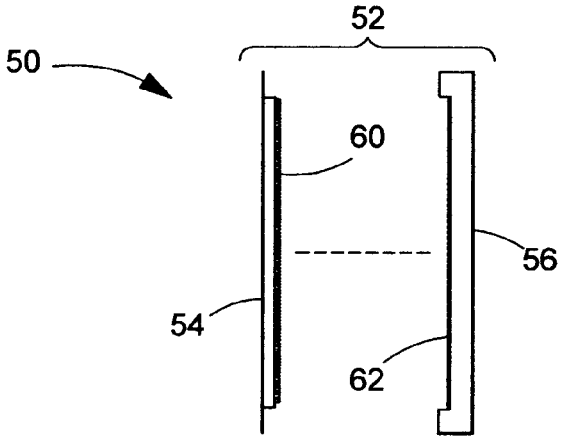
FIG. 6*c* is an exploded side view of the body similar to that depicted in FIG. 4*c* as applicable to the cover system depicted in FIG. 5*a* and FIG. 5*b;*
Figure 6D:
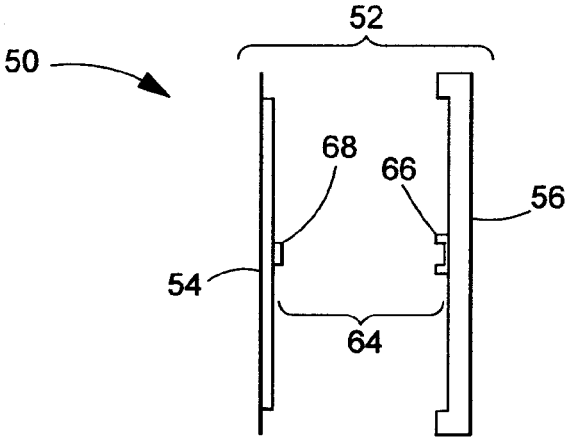
FIG. 6*d* is an exploded side view of the body similar to that depicted in FIG. 4*d* as applicable to the cover system depicted in FIG. 5*a* and FIG. 5*b;*

Referring specifically to FIG. 1 through FIG. 3, a facade or cover 10 for a satellite dish D is depicted in accordance with at least one embodiment of the present invention. In one embodiment of the present invention, the facade 10 is an integral unit having a magnet or magnetic base 14 by which the facade 10 is removably attachable to and removably detachable from the parabolic structure P of the satellite dish D. The facade 10 may have indicia 18 of many different varieties and themes. In this embodiment, the facade 10 has a non-removable and non-interchangeable indicia 18. The magnet or magnetic base 14 is magnetically attracted to the metal composition of the parabolic structure P used as part of the satellite dish D. The magnet or magnetic base 14 does not interfere with the transmission of signals by the satellite dish D.

In another embodiment of the present invention, the facade 10 for a satellite dish D has a body 12 comprising a magnetic base 14 and a face 16 coupled to the base 14. The body 12 is arranged so that the magnetic base 14 is oriented to the rear of the body 12, and the face is oriented to the front of the body 12, so that when the body 12 is placed onto the surface of the parabolic structure P, the face 16 is visible to onward observers and the magnetic base 14 is adjacent to and coupled with the surface of the parabolic structure P. The face 16 may have indicia 18 substantially similar to that described above.

Referring now to FIG. 4*a* through FIG. 4*e*, the face 16 may be removably attachable to and removably detachable from the magnetic base 14. This may be accomplished in several ways via attachment means 17, including but not limited to a magnet 20, hook 22 and loop 24 material, and/or a snap button 26, or other buttons and fasteners, as shall be described in greater detail hereafter. In one embodiment, the face 16 is removable to and from the base 14 via attachment means such as a magnet 20, in which magnet 20 is attracted to the magnet M of the base 14. The magnet 20 is positioned on the rear portion 32 of the face 16. The magnet 20 is magnetically attracted to the magnet or magnetic base 14 of body 12, thereby coupling the face 16 to the base 14. In another embodiment, the face 16 is removable to and from the base 14 via attachment means 17 such as hook 22 and loop 24 material. Either the hook 22 or the loop 24 material is attached to the magnet or magnetic base 14 on an exterior surface, and the corresponding and complementary hook 22 or loop 24 material remaining is attached to the rear portion 32 of the face 16. In yet another embodiment, the face 16 is removable to and from the base 14 via attachment means 17 such as a snap button 26, the snap button 26 comprising a button 28 and a corresponding post 30. Either the button 28 or the post 30 is attached to the magnet or magnetic base 14 on an exterior surface, and the corresponding and complementary button 28 or post 30 remaining is attached to the rear portion 32 of the face 16. The means for attaching, detaching and interchanging the face 16 with the base 14 is not limited to the means described above, and are provided only as an illustration of the various means envisioned. In the embodiments depicted in FIG. 4*a* through FIG. 4*e*, and especially in FIG. 4*e*, the base 14 has an integral or embedded magnet M and a perimeter 34 circumscribing the magnet M that is configured to receive and seat a perimeter 36 of the face 16.

In another embodiment, and referring to FIG. 5*a*, FIG. 5*b* and FIG. 6*a* through FIG. 6*c*, a facade system 50 for a satellite dish D is shown in accordance with another envisioned aspect of the present invention. The cover system 50 has a body 52 comprising a magnetic base 54 and at least one face 56 removably attachable to and removably detachable from the base 54, the face 56 having indicia 58. As described above, in relation to the description of the face 16 being removable to and from the magnet or magnetic base 14 in the preceding paragraph. It is envisioned that the system 50 will have at least one additional face 56, and may include a plurality of faces 56, in which each face 56 is removable to and from the magnetic base 54. Thus, the faces 56 may be attached and/or interchanged onto and from the base 54 via attachment means 57, such as but not limited to an additional magnet 58, hook 60 and loop 62 material, and/or a snap button 64 (comprising a button 66 and post 68) in the respective manner described above.

Figure 7A:
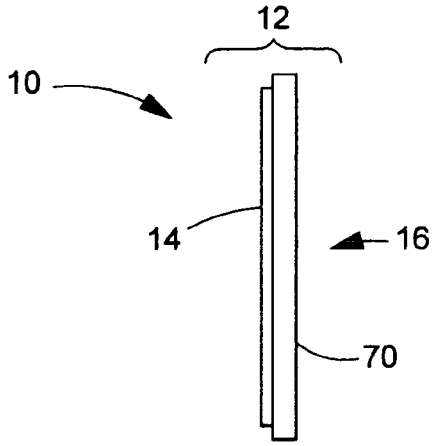
FIG. 7*a* is a side view of the body depicting a vinyl exterior.
Figure 7B:
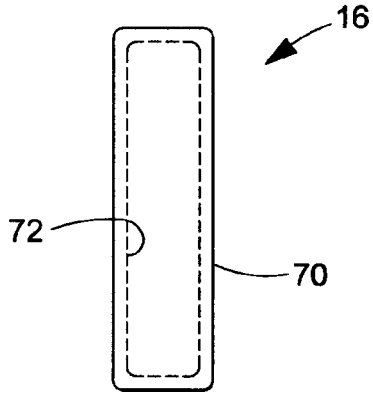
FIG. 7*b* is a side view of the body depicting a vinyl exterior with a foam material or insert placed within the interior of the vinyl face.
Figure 7C:
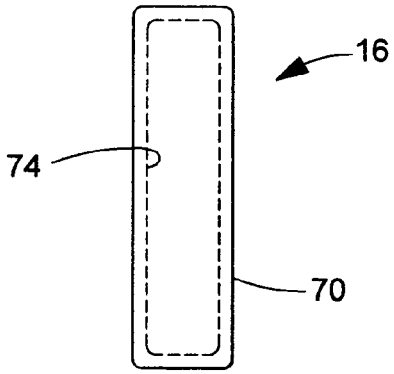
FIG. 7*c* is a side view of the body depicting a vinyl exterior with an inflatable internal volume formed within the interior of the vinyl exterior face, the inflatable internal volume capable of being inflated by air, fluid or solid.

In each of the preceding embodiments having a face or faces (16 or 56), the composition of the face(s) 16 or 56 may comprise a variety of substances, including a variety of plastic or polymeric material. In one embodiment, the face (s) 16 or 56 comprises a hardened plastic, similar to that of children's toys, thereby providing a durable and protective material that is easily washable. In another embodiment, and referring to FIG. 7*a* through FIG. 7*c*, the face(s) 16 or 56 comprises a vinyl exterior 70. The vinyl exterior 70 may enclose or envelope a foam insert or material 72 that creates a cushioned protective cover 10 or 50 for the satellite dish D. The vinyl exterior 70 may also form an inflatable internal volume 74 that may be inflated by air, fluid or solid material, such as sand, organic husks, polystyrene or other suitable material. The volume 74 may be altered or adjusted as desired between complete inflation and complete deflation. It is further envisioned that in another aspect of the invention, the facade 10 or the facade system 50 is fabricated from material that provides flexibility to the cover. It is intended that the facade is conformable to the concavity of the satellite dish D and the parabolic structure P thereof. In such an embodiment, the facade rests or abuts completely against the parabolic surface or structure P. In such an embodiment, the magnet or magnetic base 14 is formed from a thin magnetic material so that flexibility is inherent in the device or apparatus 10, and so that conformity to the parabolic structure P is achieved.

The facade 10 may be configured or adapted to conform to a variety of geometric shapes used in the formation of a parabolic satellite dish D, such as a circular or elliptical perimeter with a parabolic surface, for example. The facade 10 is envisioned to be available in a variety of diametric sizes, as well, including a size to completely cover the dish D, and further including a diameter that is significantly smaller than the diameter of the dish D, and diametric sizes in between. The facade 10 is envisioned as being manufactured from material(s) that permit a variety of color variations, including solid colors and multicolor variations, and further including a variety of indicia, such as licensed trademarks, including that of cartoon characters, professional and collegiate athletic teams, household themes, patriotic themes, endorsement of a political party, candidate or cause, and other indicia to signify brand loyalty to a wide array of products available in commerce.

Figure 8E:
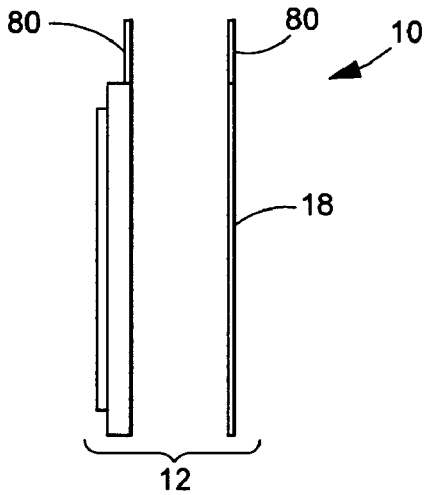
FIG. 8*e* is a side view of the embodiment depicted in FIG. 8*a;*
Figure 8A:
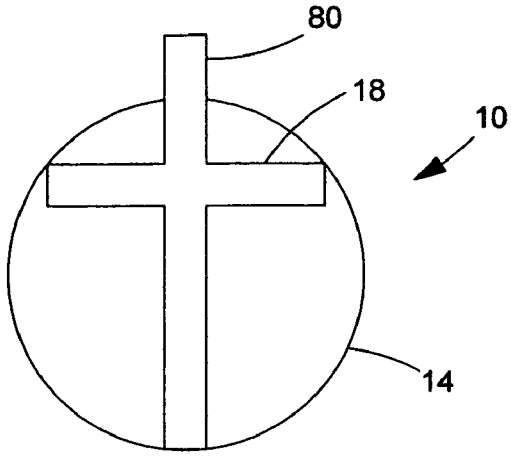
FIG. 8*a* is a front view of an embodiment having indicia (Christian cross) that exceeds the diameter of the parabolic structure.
Figure 8F:
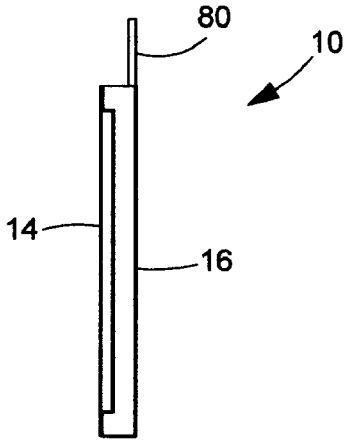
FIG. 8*f* is a side view of the embodiment depicted in FIG. 8*a*, as applied to a body having a face removable from the base.
Figure 8B:
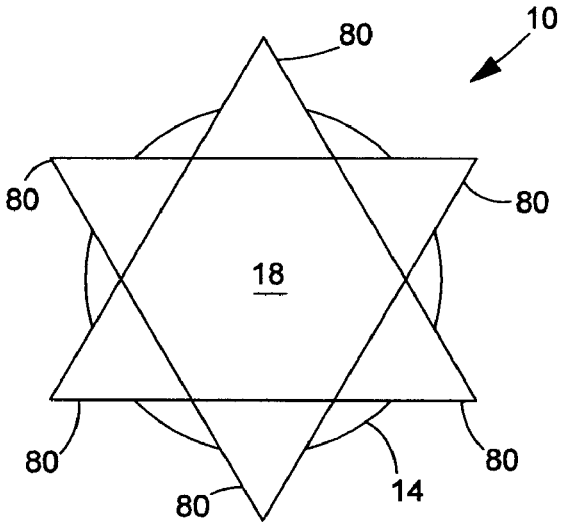
FIG. 8*b* is a front view of an embodiment having indicia (Jewish Star of David) that exceeds the diameter of the parabolic structure.
Figure 8C:
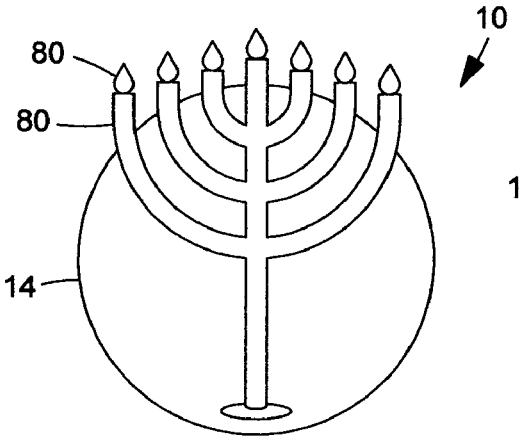
FIG. 8*c* is a front view of an embodiment having indicia (Jewish Menorah) that exceeds the diameter of the parabolic structure.
Figure 8D:
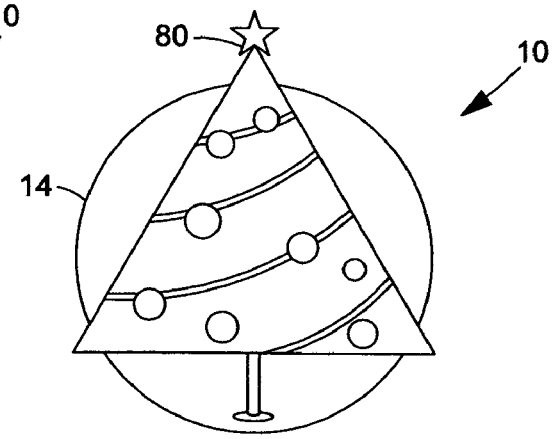
FIG. 8*d* is a front view of an embodiment having indicia (Christmas tree) that exceeds the diameter of the parabolic structure.
Figure 9:
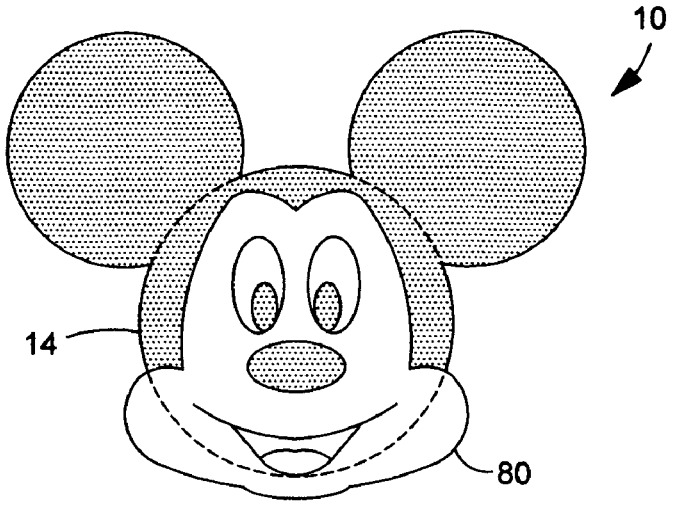
FIG. 9 is a front view of an embodiment having indicia that exceeds the diameter of the parabolic structure.

The facade 10 may also be configured or arranged so as to have excess structure 80 for supporting excess indicia 82 that exceeds the diameter of the parabolic structure P. For instance, and as depicted in FIG. 8*a* through FIG. 8*f*, religious or holiday symbols/indicia are shown in which elements or portions of the indicia exceed the perimeter of the parabolic structure P. A Christian cross (FIG. 8*a*), a Star of David (FIG. 8*b*), a Menorah (FIG. 8*c*), and a Christmas tree with ornamentation (FIG. 8*d*), for example, exceed the diameter of the parabolic structure P, and each is supported by a corresponding structure 80 formed on the body 12 (depicted in FIG. 8*e* as a side view of an integral cover unit, and depicted in FIG. 8*f* as a side view of an embodiment having a face removable from the base). FIG. 8*e* depicts an exploded side view with the indicia 18 separated, and the excess indicia 82 corresponding to the excess structure 80 on body 12. In another embodiment, the face of a famous character, including but not limited to Disney(™) characters, is provided as indicia for the cover 10 (with the ears of the character protruding from the perimeter of the parabolic structure P as shown in FIG. 9).

Figure 10A:
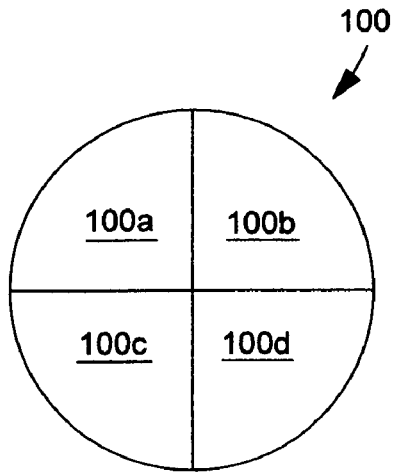
FIG. 10*a* is a front view of an embodiment having a facade with a divided face or front.
Figure 10B:
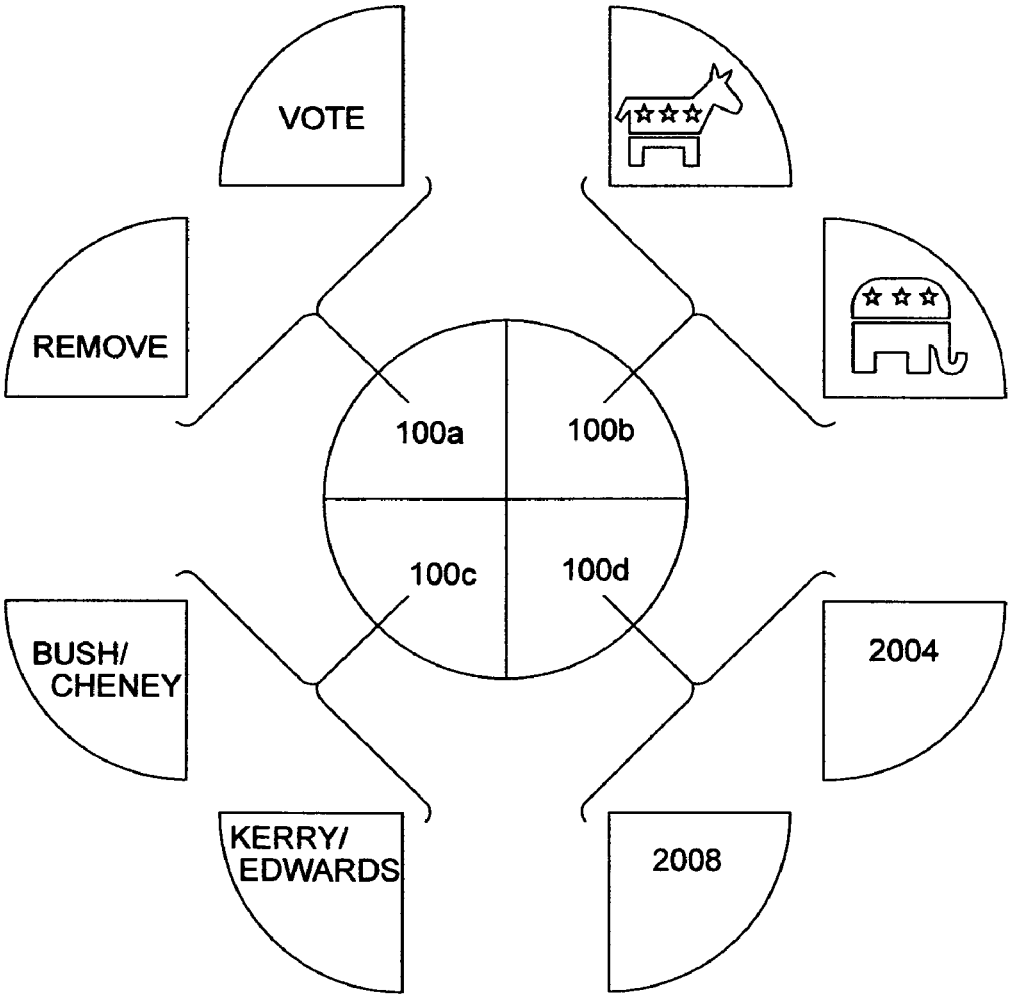
FIG. 10*b* is an exploded front view of FIG. 10*a* providing various choices for creating a message.
Figure 11A:
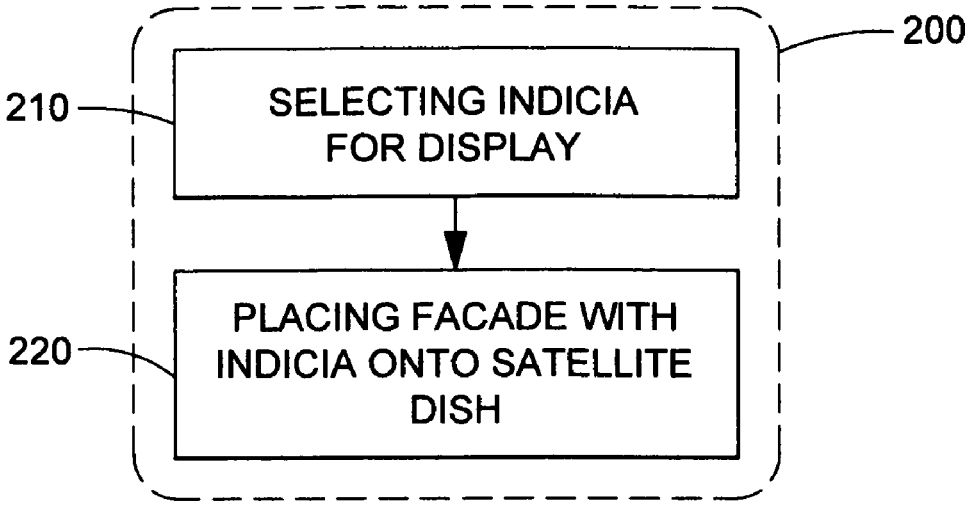
FIG. 11 is a diagram of the method of advertising utilizing a satellite dish and a satellite dish facade described in the figures above.
Figure 11B:
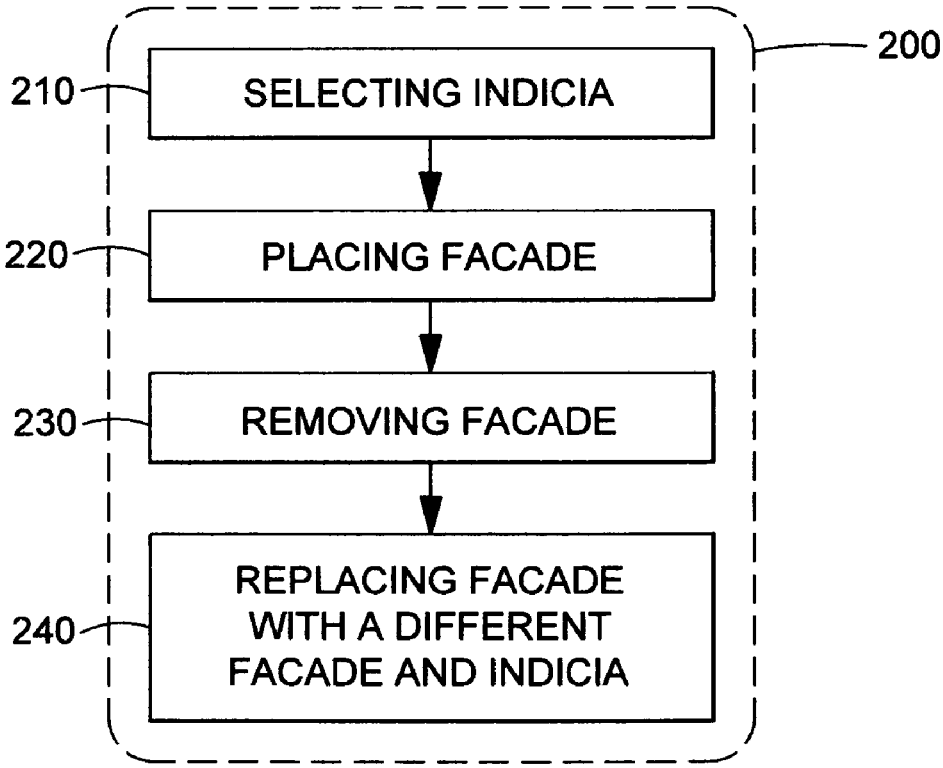

The facade 10 may be configured and adapted to provide a divided cover 100. For instance, and as depicted in FIG. 10*a* and FIG. 10*b*, the cover 100 may be divided into multiple portions or parts, equally or unequally (such as thirds, fourths and fifths, or having horizontal strips of varied height, for instance), so as to enhance the versatility of the device 100. The face of the cover comprises a plurality of elements 100*a*, 100*b*, 100*c*, and 100*d*, respectively (as depicted) that are removable to and from a face, and are complementary to one another so as to form a message. In FIG. 10*a* and FIG. 10*b*, the cover 100 comprises components or elements 100*a*, 100*b*, 100*c*, and 100*d*, respectively. In this embodiment, each component or element 100*a*, 100*b*, 100*c*, and 100*d*, respectively, provides a user with the opportunity to create a political endorsement (as one example). For example, component or element 100*a* may provide the selection of either "VOTE" or "REMOVE" or "DEFEAT" a particular candidate or political party. Component or element 100*b* may provide the selection of either the republican symbol (the elephant) or the democratic symbol (the donkey). Component or element 100*c* may provide the selection of either the republican party nominees for president and vice president in 2004(Bush-Cheney) or the democratic party nominees for president and vice president in 2004(Kerry-Edwards). Component or element 100*d* may provide the selection of a particular election cycle of year (such as "2004" or "2008", respectively).

A method of advertising 200 utilizing a satellite dish 202 and a magnetic satellite dish facade or cover 204 is envisioned, with the method 200 comprising the steps of selecting indicia 210 for display, and placing 220 the facade 204 on the satellite dish 202. The method of advertising 200 may also comprise the additional steps of removing 230 the facade 204, and replacing 240 the facade 204 with another facade 204' having different indicia. As described above in its various embodiments, the facade may comprise a magnetic base coupled with a face having indicia, including all the variations described previously incorporated by reference herein as if fully rewritten. Also as described above, the facade may comprise a magnetic base coupled with a face having indicia, wherein the face is removable to and from the base via attachment means, including all the variations described previously incorporated by reference herein as if fully rewritten.

What is claimed is:

1. A facade for a satellite dish having a body comprising:

a base comprising a magnet; and a face coupled to the base, the face comprising a vinyl exterior and a foam interior.

2. The facade of claim 1, wherein the face has indicia.

3. The facade of claim 1, wherein the face is removable to and from the base via attachment means.

4. The facade of claim 1, wherein the face comprises plastic.

5. The facade of claim 1, wherein the face forms an inflatable internal volume.

6. The facade of claim 1, wherein the face comprises a plurality of elements removable to and from the face, the elements complementary to one another so as to form a message.

7. A facade for a satellite dish having a body comprising:

a base comprising a magnet; and a face coupled to the base, the face comprising a vinyl exterior and an inflatable internal volume.

8. The facade of claim 7, wherein the face has indicia.

9. The facade of claim 7, wherein the face is removable to and from the base via attachment means.

10. The facade of claim 7, wherein the face comprises plastic.

11. The facade of claim 7, wherein the face forms a foam interior.

12. The facade of claim 7, wherein the face comprises a plurality of elements removable to and from the face, the elements complementary to one another so as to form a message.

13. A facade system for a satellite dish, the system comprising:

a base comprising a magnet;

at least one face removable to and from the base via attachment means, wherein the at least one face has indicia;

at least one additional face interchangeable with the at least one face, the at least one additional face removable to and from the base via attachment means; and each face comprises a vinyl exterior and a foam interior.

14. The facade of claim 13, wherein each face comprises plastic.

15. The facade of claim 13, wherein each face forms an inflatable internal volume.

16. The facade of claim 13, wherein each face comprises a plurality of elements removable to and from each face, the elements complimentary to one another so as to form a message.

17. A facade system for a satellite dish, the system comprising:

a base comprising a magnet;

at least one face removable to and from the base via attachment means, wherein the at least one face has indicia;

at Least one additional face interchangeable with the at least one face, the at least one additional face removable to and from the base via attachment means; and each face comprises a vinyl exterior and an inflatable internal volume.

18. The facade of claim 17, wherein each face comprises plastic.

19. The facade of claim 17, wherein each face forms a foam interior.

20. The facade of claim 17, wherein each face comprises a plurality of elements removable to and from each face, the elements complimentary to one another so as to form a message.

* * * * *